United States Patent [19]

König et al.

[11] 4,049,206

[45] Sept. 20, 1977

[54] COMMINUTING MACHINE FOR TRASH

[75] Inventors: Rolf König, Handorf; Bernhard Nordemann, Munster; Herbert Motek, Altenberge, all of Germany

[73] Assignee: Hazemag Dr. E. Andreas Kg, Munster, Germany

[21] Appl. No.: 675,052

[22] Filed: Apr. 8, 1976

[30] Foreign Application Priority Data

Apr. 12, 1975 Germany ..... 2516014

[51] Int. Cl.[2] ..... B02C 13/02

[52] U.S. Cl. ..... 241/73; 241/189 A; 241/190; 241/241; 241/285 B

[58] Field of Search ..... 241/27, 73, 189 R, 189 A, 241/190, 239, 240, 241, 285 B

[56] References Cited

U.S. PATENT DOCUMENTS

| | | | |
|---|---|---|---|
| 3,128,953 | 4/1964 | Wageneder | 241/241 |
| 3,343,800 | 9/1967 | Rasmussen | 241/189 R X |
| 3,480,214 | 11/1969 | Wageneder | 241/73 X |
| 3,531,055 | 9/1970 | Alt | 241/285 B X |
| 3,602,444 | 8/1971 | Meyer | 241/239 X |
| 3,659,792 | 5/1972 | Conrad et al. | 241/27 X |

FOREIGN PATENT DOCUMENTS

| | | | |
|---|---|---|---|
| 1,960,913 | 7/1970 | Germany | 241/189 R |

*Primary Examiner*—Roy Lake

*Assistant Examiner*—Howard N. Goldberg

*Attorney, Agent, or Firm*—Michael J. Striker

[57] ABSTRACT

A comminuting machine for trash has a generally closed housing provided at its top with an inlet and its bottom with an outlet. A rotor is provided in the housing and has at least one radially extending beater element that orbits on rotation of the rotor in a predetermined sense about a horizontal axis. An impact member is provided in the housing generally above the axis and spaced radially from the orbit of the beater element, the inlet being upstream of this impact member relative to the rotational sense of the rotor. A crusher plate is pivotally mounted in the housing generally below and downstream of the impact member and may be pivotally displaced between an effective position spaced radially relatively close to the rotor and an ineffective position radially relatively far from the rotor. A grate is displaceable through a sidewall of the housing between a withdrawn position outside the housing and an operative position under and relatively closely spaced from the rotor at the outlet. The side of the housing through which the grate is displaceable can be closed regardless of which position the grate is in and according to a special feature the rotor can be reversed so that the beater elements thereon can coact with a tearing comb mounted in the other sidewall of the housing for comminution of elastic or tough material.

11 Claims, 3 Drawing Figures

11
3
10
2
9
8
6
5
B
7
29
30
35
M
14
12
A
4
34
1
18
19
7
15
6
28
20
23
37
27
17
13
22
21
16
26
24
24
25

2
9
8
5
29
3
B
13
12
34
4
A
38
28
20
36
15
21
23
6
26
1
24
25
24
37

2
9
8
5
33
32
29
3
C
A
30
13
12
4
31
28
20
15
38
21
23
1
6
26

COMMINUTING MACHINE FOR TRASH

BACKGROUND OF THE INVENTION

The present invention relates to a comminuting machine. More particularly this invention concerns an apparatus for milling trash and refuse of various types.

Whether trash and refuse both from commercial or industrial sources and from households is to be partially or completely recycled or partially or completely dumped it is frequently necessary to cumminute this trash. Such comminution is particularly required in recycling operations as reclamation of the various components is greatly facilitated when the trash or refuse has been reduced to relatively small particle size.

It is known to comminute standard household garbage by means of a hammer mill in which the hammers are pivotally mounted on a horizontal shaft and crushing is effected by dropping the material to be comminuted onto the hammers so that it is hit by these hammers and then thrown against a breaker plate where it is impacted. In such an arrangement the rotor is turned at extremely high speed so that even relatively durable objects are broken and crushed as they are impacted. Such a machine cannot typically be used for bulky items which simply jam up between the hammer and the breaker plate and jam the device. In addition if a fibrous non-frangible is to be comminuted in such a machine it is necessary to provide a so-called tearing comb between whose teeth pass the beater elements or hammers on the rotor. It is also possible to provide this tearing comb directly on the breaker plate of a hamer mill. Thus the crushing is combined with a shredding or shearing operation.

Another difficulty with the known trash-comminuting systems is that elastic or tough objects, such as vehicle tires, or either not comminuted in the machine or jam the machine. When such an object is put in a normal hammer mill provided as described above with a tearing comb the result is frequently that the tire simply bounces and travels on top of the rotor, taking a very long time before it is eventually pinched between the beater elements and the tearing comb. Then it is possible in such systems that the elastic or tough pieces of rubber jam up in the machine beyond the tearing comb.

A further problem with many of the known arrangements is that it is relatively difficult to service them and replace the wear-prone surfaces of the impact member and crusher plate.

Most of the known systems require several different types of comminuting machines to be associated with a sorting device that feeds to each of the comminuting machines that type of material on which the particular machine is intended to act.

Various comminuting devices and systems are also described in U.S. Pat. Nos. 2,767,929 and 2,973,909, in German Pat. Nos. 163,554 and 704,853, in Swiss Pat. 466,008, in German published specifications 1,657,119, 1,931,250 and 2,146,362 as well as in German published patent 2,034,074 and the article in "Deutsche Hebe- und Fordertechnik" (1967, Vol. 10, p. 64, FIG. 9).

SUMMARY OF THE INVENTION

It is therefore an object of the present invention to provide an improved comminuting machine.

Another object is the provision of an apparatus for comminuting various types of trash.

Yet another object is to provide such a machine which can be used to comminute standard household trash, bulkier refuse and even elastic or tough and normally hard-to-comminute items such as motor-vehicle tires.

Another object of this invention is to provide an improved method of comminuting various types of refuse and the like.

These objects are attained according to the present invention in an apparatus having a generally closed housing provided at its top with an inlet and its bottom with an outlet. A rotor is rotatable in the housing about a horizontal axis and is provided with at least one radially projecting beater element. Means is provided for rotating the rotor about the axis in a predetermined rotational sense and an impact member is provided in the housing generally above the axis and spaced radially from the orbit of the beater element, the inlet being upstream of this impact member relative to the rotational sense of the rotor. A crusher plate is pivotally mounted in the housing generally below and downstream of the impact member and means is provided for pivoting the crusher plate between an effective position spaced radially relatively close to the rotor and an ineffective position radially relatively far from the rotor. A grate is displaceable through a hole in a sidewall of the housing between a withdrawn position outside the housing and an operative position under and relatively closely spaced from the rotor at the outlet. Means is provided for closing the hole in the sidewall of the housing when the grate is in the withdrawn position and when the grate is in the operative position.

In accordance with the present invention the trash to be comminuted is therefore dropped into the orbit of a continuously orbiting beater element and is thrown by the orbiting beater element against an impact member in the housing. When the trash is bulky the crusher plate and the grate are displaced into their withdrawn and ineffective positions, respectively, so that the impacted trash will be comminuted only by impact effect and will be discharged thereafter directly from the comminutor. When, however, the trash is not bulky and not relatively wet the crusher plate is juxtaposed with the orbit of the beater element, that is it is placed in its operative and effective position, so that the impacted trash is ground between the rotor and the crusher plate and thereafter is passed out of the housing. If the trash is dry the crusher plate and the grate are placed in their effective positions so that the impacted and ground trash passes thereafter through the grate.

With the system according to the present invention it is therefore possible to use the comminutor for different kinds of trash. Different mills for different fractions of the trash need not be provided, in addition to a classifying apparatus, but a single apparatus may be employed for all types of trash.

In accordance with another feature of this invention radially inwardly projecting and axially spaced teeth are fixed on the impact members. According to this invention the beater elements can mesh with and pass between the teeth of the impact member. Thus it is possible to effect shearing between the beater elements on the rotor and the teeth on the impact member. Such a tearing is very effective for reducing fibrous trash which is not broken by being thrown against the impact member.

In accordance with yet another feature of this invention the housing has an upper portion and a lower portion. The upper portion may be pivoted away from the lower portion about a horizontal axis fixed on the lower portion, and this upper portion carries the pivot axis for the crusher plate and the breaker plate. When swung out for renewing the wear-prone surfaces of these two elements the surfaces to be renewed are therefore very well exposed to make servicing very easy.

According to yet another feature of this invention the grate is horizontally reciprocable between the withdrawn and operative positions. It is provided at one end with a plate which fills and closes the hole in the sidewall of the housing when the grate is in the operative position. A plate at its other end cooperates with a flap pivoted on the sidewall of the housing to close this hole in the withdrawn position.

The apparatus according to the present invention is further provided with a tearing or shear comb between the feed inlet and the outlet. This comb is generally radially reciprocable between an outer position spaced well from the rotor and an inner position in which the teeth on the comb mesh with the beater elements on the rotor. In case relatively soft but otherwise extremely hard to comminute items must be comminuted by the machine the rotation direction of the rotor is reversed and this comb is pushed into its inner position. In this case the device acts like a shredder, quickly reducing the automobile tire or the like to small pieces. In order to prevent the grate from jamming up during such operation it is held in the withdrawn position. It is also a feature of this invention that the rotor is provided between the sets of beater elements with axially extending grooves that prevent elastomeric or spongy items in the trash from becoming wedged between the rotor and the grate or any of the other elements of the comminuting machine.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

DESCRIPTION OF THE PREFERRED EMBODIMENT

Figure 1:
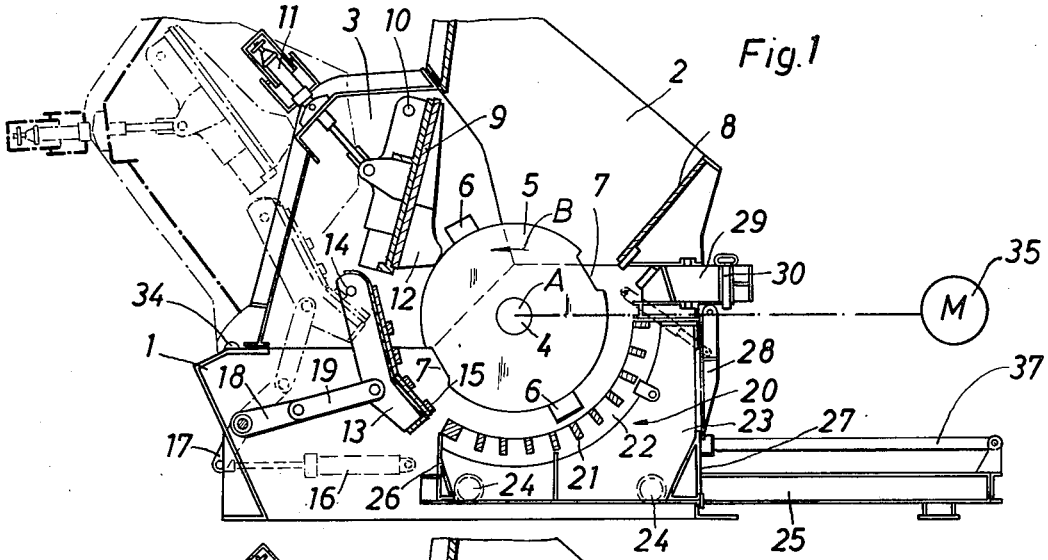
FIG. 1 is a vertical section through the machine according to this invention shown set up for comminuting normal trash or refuse.
Figure 2:
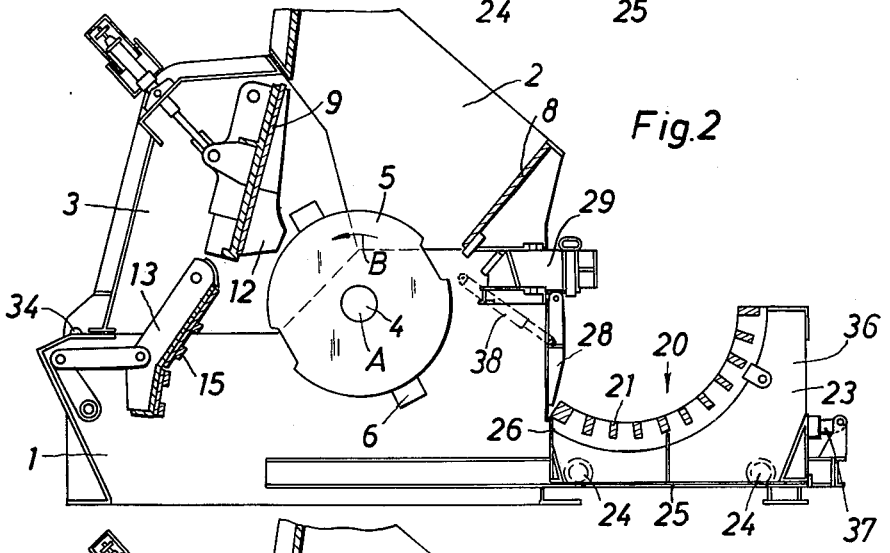
FIG. 2 is a similar section through the machine shown set up for relatively bulky trash or refuse.
Figure 3:
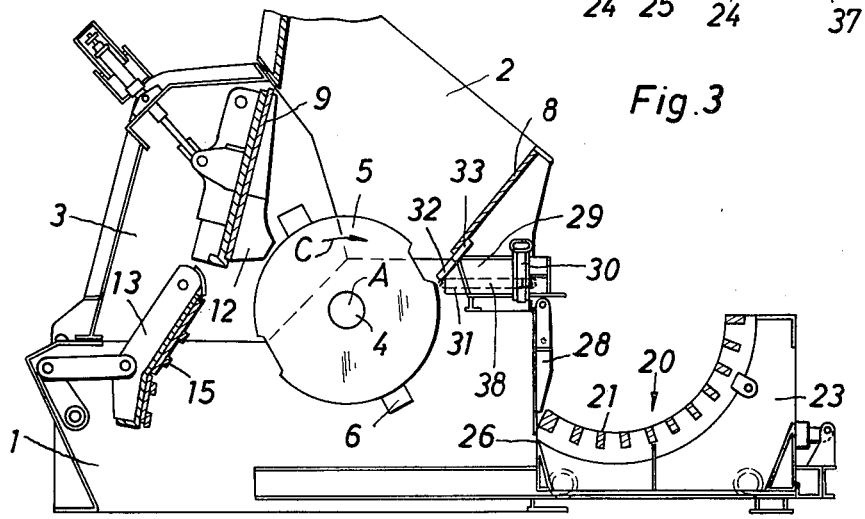
FIG. 3 is a similar section through the machine shown set up for comminuting old tires or similar elastic or tough items.

The apparatus according to the present invention has as shown in FIGS. 1–3 a housing formed of lower stationary portion 1, an upper stationary portion 2, and an upper portion 3 pivotal about an axis 34 relative to the lower portion 1. A horizontal shaft 4 defining a horizontal axis A passes through the lower portion 1 and is connected to a reversible motor 35. This shaft 4 carries a cylindrical rotor 5 which is provided on diametrically opposite sides with axial rows of axially spaced beater elements 6. In addition on axially opposite sides of the rotor 5, offset by 90° to the elements 6, are grooves 7 extending axially the full length of the rotor 5.

The upper section 2 is formed with an inlet 8 which serves to feed trash to be comminuted to the upper right-hand quadrant of the rotor 5 as shown in FIGS. 1–3. Above the upper left-hand quadrant of the rotor 5 there is provided an impact member 9 that is pivotal on the housing portion 2 about a horizontal pivot axis 10 and whose position is determined by a hydraulic cylinder 11. The member 9 is provided at its end closest the rotor 5 with tearing teeth 12 between which pass the beater elements 6 of the rotor 5 as these teeth 6 orbit about the axis A.

Below the impact member 9 there is provided a crusher plate 13 pivoted at horizontal axis 14 on the housing portion 3 and provided with crusher bars 15. The space defined between this member 13 and the rotor 5 normally is of decreasing radial size when the rotor 5 is turned in the direction indicated by arrow B in FIGS. 1 and 2. A hydraulic cylinder 16 secured to one end wall of the housing portion 1 has its piston rod connected to one arm 17 of a lever whose other arm 18 is connected via a link 19 to the crusher plate 13 so that operation of this ram 16 can pivot it into the position indicated in FIG. 1 and the ineffective position indicated in FIGS. 2 and 3.

For servicing of the wear-prone surfaces of the members 9 and plate 13 the entire housing portion 3 is tipped back as indicated by dot-dash lines in FIG. 1 so as to expose these members clearly. In this tipped-back position the teeth 12 and bars 15 can readily be replaced, along with other wear-prone portions of these members 9 and 13.

A grate 20 is provided under the rotor 5 and is formed by a plurality of axially extending bars 21 extending between end plates 22 carried on a frame 23 displaceable by means of rollers 24 and rails 25 extending outside the machine housing. This grate 20 is displaceable between the effective or operative position shown in FIG. 1 and the withdrawn position shown in FIGS. 2 and 3 by means of a hydraulic cylinder 37. In the operative position shown in FIG. 1 the flap 28 covers a hole 36 in one side plate 27 of the grate 20. In the withdrawn position shown in FIGS. 2 and 3 the flap 28 covers the open hole above the upper edge of the other end plate 26 of the grate 20. The bars 21 of the grate 20 extend substantially over a quarter cylinder which is arranged in the frame 23, so that the entire frame 23 can be moved in and out without the grate section lying furthest from the exit hole interfering with the rotor 5.

Mounted above the grate 20 and below the feed inlet 8 is a tearing comb 29 which is slidable via hydraulic cylinders in a corresponding slot in the housing section 1 and which can be locked in an inner position as shown in FIG. 3 or an outer position as shown in FIGS. 1 and 2 by means of a bolt or pin 30. This comb is provided with teeth 31 whose working edges are protected by means of wear elements 32. Blades 33 are spaced directly above the comb 29 and fill the spaces between the teeth 31. The blades 33 extend close to the orbit of the beater elements 6. The position of the above mentioned hydraulic cylinder 38 can be changed to control in addition a flap 28.

It is noted that the rotor 5 can have more than two rows of beater elements 6 and instead of a single breaker plate, a single crusher member and grid, two or more of each can be fitted.

When the device is set up as shown in FIG. 1 normal not-bulky trash is fed into the chute 2. This trash is thrown by the beater elements 6 against the impact member 9 which breaks up most of the frangible portions of the trash and is then ripped apart by interaction of the beater elements 6 with the tearing teeth 12. The trash then drops down and is crushed against the crusher plate 13 and passes out of the housing between the bars 21 of the grate 20. Incompletely comminuted trash will simply be swept around on the grate 20 and thrown against the impact member 9 again to be recycled until it is the proper small size.

When coarse or bulky material is to be comminuted the rotor 5 is still rotated in direction B, but the crusher plate 13 and grate 20 are fully withdrawn by actuating cylinders 16 respectively 37, and the hole in the sidewall is closed with the flap 28 actuated by cylinder 38. It is therefore possible to coarsely comminute material without having to worry about the comminuting machine jamming up.

When elastic or tough material is to be comminuted the machine is set up as shown in FIG. 3. To this end the motor 35 is reversed so that the rotor 5 is turned in a rotational sense indicated by arrow C and the tearing comb 29 is pushed in and secured by means of the bolt 30. The beater elements 6 therefore coact with the teeth 31 of the comb to cut up the elastic or tough material such as tires, mattresses, or the like. The grate 20 is held in withdrawn position during this operation as such material readily clogs a normal grate.

It will be understood that each of the elements described above, or two or more together, may also find a useful application in other types of machines differing from the types described above.

While the invention has been illustrated and described as embodied in a trash comminuter, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An apparatus for comminuting trash and the like, said apparatus comprising:

a generally closed housing having at its top an inlet and at its bottom an outlet;

a rotor in said housing rotatable about a horizontal axis and provided with at least one radially extending beater element;

means for rotating said rotor about said axis in a predetermined rotational sense;

an impact member in said housing generally above said axis and spaced radially from the orbit of said beater element, said inlet being upstream of said impact member relative to said sense;

a crusher plate pivotally mounted in said housing generally below and downstream of said impact member;

means for pivoting said crusher plate between an effective position spaced radially relatively close to said rotor and an ineffective position radially relatively far from said rotor; and a grate displaceable through a hole in a sidewall of said housing between a withdrawn position outside said housing and an operative position under and relatively closely spaced from said rotor at said outlet.

2. The apparatus defined in claim 1, further comprising means for closing said hole in said sidewall of said housing when said grate is in said withdrawn position and when said grate is in said operative position.

3. The apparatus defined in claim 2 wherein said impact member is provided with a plurality of tearing teeth, said beater element being constituted by a plurality of axially spaced beater teeth engageable between said tearing teeth on rotation of said rotor.

4. The apparatus defined in claim 2 wherein said housing has a stationary lower portion carrying said means for rotating and said rotor, and has an upper portion pivotal relative to said lower portion and carrying said impact member.

5. The apparatus defined in claim 2 wherein said means for closing includes a flap pivoted on said sidewall and a pair of end plates on said grate, one of said end plates and said flap closing said hole in said sidewall in each of said positions of said grate.

6. The apparatus defined in claim 2, further comprising a tearing comb in said housing between said outlet and said inlet and relative to said sense upstream of said inlet and downstream of said outlet, said means for rotating being reversible for rotating said rotor in a sense opposite the first-mentioned sense.

7. The apparatus defined in claim 6 wherein said rotor is provided with a plurality of such beater elements formed as a row of axially spaced teeth, said comb having a plurality of blades closely juxtaposable with the orbit of said teeth.

8. The apparatus defined in claim 6 wherein said comb is displaceable between an inner position relatively close to said rotor and an outer position relatively far from said rotor and is provided with means for locking itself in either of said inner and outer positions.

9. The apparatus defined in claim 8 wherein said means for closing includes a flap pivoted on said sidewall and a pair of end plates on said one of said end plates and said flap closing said hole in each of said positions of said grate and a hydraulic cylinder selectively engageable with said comb and with said flap for displacing same, one of said end plates and said flap closing said hole in said sidewall in each of said positions of said grate.

10. The apparatus defined in claim 1 wherein said rotor is formed angularly offset from said beater element with an axially extending groove.

11. The apparatus defined in claim 1 wherein said crusher plate is radially closer to said rotor when in said effective position than said impact member.

* * * * *